US009447613B2

(12) United States Patent
Salter et al.

(10) Patent No.: US 9,447,613 B2
(45) **Date of Patent: *Sep. 20, 2016**

(54) PROXIMITY SWITCH BASED DOOR LATCH RELEASE

(71) Applicant: Ford Global Technologies, LLC, Dearborn, MI (US)

(72) Inventors: Stuart C. Salter, White Lake, MI (US); Yun Shin Lee, Shelby Township, MI (US); Pietro Buttolo, Dearborn Heights, MI (US); Cornel Lewis Gardner, Romulus, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 85 days.

This patent is subject to a terminal disclaimer.

(21) Appl. No.: 14/552,809

(22) Filed: Nov. 25, 2014

(65) Prior Publication Data

US 2015/0077227 A1 Mar. 19, 2015

Related U.S. Application Data

(63) Continuation of application No. 13/609,390, filed on Sep. 11, 2012, now Pat. No. 8,922,340.

(51) Int. Cl.

| | |
|---|---|
| ***E05B 81/76*** | (2014.01) |
| ***E05B 85/12*** | (2014.01) |
| ***E05B 81/00*** | (2014.01) |
| ***E05C 19/02*** | (2006.01) |
| ***G07C 9/00*** | (2006.01) |

(52) U.S. Cl.

CPC ..... *E05B 81/77* (2013.01); *E05B 81/00* (2013.01); *E05B 81/76* (2013.01); *E05B 85/12* (2013.01); *E05C 19/02* (2013.01); *G07C 9/00714* (2013.01)

(58) Field of Classification Search

CPC ..... E05B 81/76; E05B 81/77; E05B 81/78; G07C 2209/65; G07C 2209/64; E05Y 2400/86; E05Y 2800/426; E05Y 2800/424

See application file for complete search history.

(56) References Cited

U.S. PATENT DOCUMENTS

| | | | |
|---|---|---|---|
| 3,382,588 | A | 5/1968 | Serrell et al. |
| 3,544,804 | A | 12/1970 | Gaumer et al. |

(Continued)

FOREIGN PATENT DOCUMENTS

| | | |
|---|---|---|
| DE | 4024052 | 1/1992 |
| EP | 1152443 | 11/2001 |

(Continued)

OTHER PUBLICATIONS

"Clevios P Formulation Guide," 12 pages, www.clevios.com, Heraeus Clevios GmbH, no date provided.

(Continued)

*Primary Examiner* — Andrew Bee

(74) *Attorney, Agent, or Firm* — Vichit Chea; Price Heneveld LLP

(57) ABSTRACT

A vehicle door latch assembly includes a first proximity sensor on a first side of a door handle and a second proximity sensor on a second side of the door handle. The assembly also includes a latch operative to latch the door closed and to unlatch the door to allow the door to open. The assembly further includes control circuitry for activating the latch to unlatch the door based on an object such as an operator's hand sensed with both the first and second proximity sensors.

19 Claims, 4 Drawing Sheets

(56) References Cited

U.S. PATENT DOCUMENTS 3,691,396 A 9/1972 Hinrichs
3,707,671 A 12/1972 Morrow et al.
3,725,589 A 4/1973 Golden
3,826,979 A 7/1974 Steinmann
3,950,748 A 4/1976 Busy
4,204,204 A 5/1980 Pitstick
4,205,325 A 5/1980 Haygood et al.
4,232,289 A 11/1980 Daniel
4,257,117 A 3/1981 Besson
4,290,052 A 9/1981 Eichelberger et al.
4,340,813 A 7/1982 Sauer
4,374,381 A 2/1983 Ng et al.
4,377,049 A 3/1983 Simon et al.
4,380,040 A 4/1983 Posset
4,413,252 A 11/1983 Tyler et al.
4,431,882 A 2/1984 Frame
4,446,380 A 5/1984 Moriya et al.
4,453,112 A 6/1984 Sauer et al.
4,492,958 A 1/1985 Minami
4,494,105 A 1/1985 House
4,502,726 A 3/1985 Adams
4,514,817 A 4/1985 Pepper et al.
4,613,802 A 9/1986 Kraus et al.
4,680,429 A 7/1987 Murdock et al.
4,743,895 A 5/1988 Alexander
4,748,390 A 5/1988 Okushima et al.
4,758,735 A 7/1988 Ingraham
4,821,029 A 4/1989 Logan et al.
4,855,550 A 8/1989 Schultz, Jr.
4,872,485 A 10/1989 Laverty, Jr.
4,899,138 A 2/1990 Araki et al.
4,901,074 A 2/1990 Sinn et al.
4,905,001 A 2/1990 Penner
4,924,222 A 5/1990 Antikidis et al.
4,972,070 A 11/1990 Laverty, Jr.
5,025,516 A 6/1991 Wilson
5,033,508 A 7/1991 Laverty, Jr.
5,036,321 A 7/1991 Leach et al.
5,050,634 A 9/1991 Fiechtner
5,063,306 A 11/1991 Edwards
5,108,530 A 4/1992 Niebling, Jr. et al.
5,153,590 A 10/1992 Charlier
5,159,159 A 10/1992 Asher
5,159,276 A 10/1992 Reddy, III
5,177,341 A 1/1993 Balderson
5,212,621 A 5/1993 Panter
5,215,811 A 6/1993 Reafler et al.
5,239,152 A 8/1993 Caldwell et al.
5,270,710 A 12/1993 Gaultier et al.
5,294,889 A 3/1994 Heep et al.
5,329,239 A 7/1994 Kindermann et al.
5,341,231 A 8/1994 Yamamoto et al.
5,403,980 A 4/1995 Eckrich
5,451,724 A 9/1995 Nakazawa et al.
5,467,080 A 11/1995 Stoll et al.
5,477,422 A 12/1995 Hooker et al.
5,494,180 A 2/1996 Callahan
5,512,836 A 4/1996 Chen et al.
5,526,294 A 6/1996 Ono et al.
5,548,268 A 8/1996 Collins
5,566,702 A 10/1996 Philipp
5,572,205 A 11/1996 Caldwell et al.
5,586,042 A 12/1996 Pisau et al.
5,594,222 A 1/1997 Caldwell
5,598,527 A 1/1997 Debrus et al.
5,670,886 A 9/1997 Wolff et al.
5,681,515 A 10/1997 Pratt et al.
5,730,165 A 3/1998 Philipp
5,747,756 A 5/1998 Boedecker
5,760,554 A 6/1998 Bustamante
5,790,107 A 8/1998 Kasser et al.
5,796,183 A 8/1998 Hourmand
5,801,340 A 9/1998 Peter
5,825,352 A 10/1998 Bisset et al.
5,827,980 A 10/1998 Doemens et al.
5,864,105 A 1/1999 Andrews
5,867,111 A 2/1999 Caldwell et al.
5,874,672 A 2/1999 Gerardi et al.
5,880,538 A 3/1999 Schulz
5,917,165 A 6/1999 Platt et al.
5,920,309 A 7/1999 Bisset et al.
5,942,733 A 8/1999 Allen et al.
5,963,000 A 10/1999 Tsutsumi et al.
5,973,417 A 10/1999 Goetz et al.
5,973,623 A 10/1999 Gupta et al.
6,010,742 A 1/2000 Tanabe et al.
6,011,602 A 1/2000 Miyashita et al.
6,031,465 A 2/2000 Burgess
6,035,180 A 3/2000 Kubes et al.
6,037,930 A 3/2000 Wolfe et al.
6,040,534 A 3/2000 Beukema
6,075,460 A * 6/2000 Minissale ..... G08C 19/00 340/12.22
6,157,372 A 12/2000 Blackburn et al.
6,172,666 B1 1/2001 Okura
6,215,476 B1 4/2001 Depew et al.
6,219,253 B1 4/2001 Green
6,231,111 B1 5/2001 Carter et al.
6,259,045 B1 7/2001 Imai
6,275,644 B1 8/2001 Domas et al.
6,288,707 B1 9/2001 Philipp
6,292,100 B1 9/2001 Dowling
6,297,811 B1 10/2001 Kent et al.
6,310,611 B1 10/2001 Caldwell
6,320,282 B1 11/2001 Caldwell
6,323,919 B1 11/2001 Yang et al.
6,369,369 B2 4/2002 Kochman et al.
6,377,009 B1 4/2002 Philipp
6,379,017 B2 4/2002 Nakabayashi et al.
6,380,931 B1 4/2002 Gillespie et al.
6,404,158 B1 6/2002 Boisvert et al.
6,415,138 B2 7/2002 Sirola et al.
6,427,540 B1 8/2002 Monroe et al.
6,445,192 B1 9/2002 Lovegren et al.
6,452,138 B1 9/2002 Kochman et al.
6,452,514 B1 9/2002 Philipp
6,456,027 B1 9/2002 Pruessel
6,457,355 B1 10/2002 Philipp
6,464,381 B2 10/2002 Anderson, Jr. et al.
6,466,036 B1 10/2002 Philipp
6,485,595 B1 11/2002 Yenni, Jr. et al.
6,529,125 B1 3/2003 Butler et al.
6,535,200 B2 3/2003 Philipp
6,535,694 B2 3/2003 Engle et al.
6,537,359 B1 3/2003 Spa
6,538,579 B1 3/2003 Yoshikawa et al.
6,559,902 B1 5/2003 Kusuda et al.
6,587,097 B1 7/2003 Aufderheide et al.
6,603,306 B1 8/2003 Olsson et al.
6,607,413 B2 8/2003 Stevenson et al.
6,614,579 B2 9/2003 Roberts et al.
6,617,975 B1 9/2003 Burgess
6,639,159 B2 10/2003 Anzai
6,646,398 B1 11/2003 Fukazawa et al.
6,652,777 B2 11/2003 Rapp et al.
6,654,006 B2 11/2003 Kawashima et al.
6,661,239 B1 12/2003 Ozick
6,661,410 B2 12/2003 Casebolt et al.
6,664,489 B2 12/2003 Kleinhans et al.
6,713,897 B2 3/2004 Caldwell
6,734,377 B2 5/2004 Gremm et al.
6,738,051 B2 5/2004 Boyd et al.
6,740,416 B1 5/2004 Yokogawa et al.
6,756,970 B2 6/2004 Keely, Jr. et al.
6,773,129 B2 8/2004 Anderson, Jr. et al.
6,774,505 B1 8/2004 Wnuk
6,794,728 B1 9/2004 Kithil
6,795,226 B2 9/2004 Agrawal et al.
6,809,280 B2 10/2004 Divigalpitiya et al.
6,812,424 B2 11/2004 Miyako
6,819,316 B2 11/2004 Schulz et al.
6,819,990 B2 11/2004 Ichinose
6,825,752 B2 11/2004 Nahata et al.
6,834,373 B2 12/2004 Dieberger

(56) References Cited

U.S. PATENT DOCUMENTS 6,841,748 B2 1/2005 Serizawa et al.
6,847,018 B2 1/2005 Wong
6,847,289 B2 1/2005 Pang et al.
6,854,870 B2 2/2005 Huizenga
6,879,250 B2 4/2005 Fayt et al.
6,884,936 B2 4/2005 Takahashi et al.
6,891,114 B2 5/2005 Peterson
6,891,530 B2 5/2005 Umemoto et al.
6,897,390 B2 5/2005 Caldwell et al.
6,929,900 B2 8/2005 Farquhar et al.
6,930,672 B1 8/2005 Kuribayashi
6,940,291 B1 9/2005 Ozick
6,960,735 B2 11/2005 Hein et al.
6,962,436 B1 11/2005 Holloway et al.
6,964,023 B2 11/2005 Maes et al.
6,966,225 B1 11/2005 Mallary
6,967,587 B2 11/2005 Snell et al.
6,977,615 B2 12/2005 Brandwein, Jr.
6,987,605 B2 1/2006 Liang et al.
6,993,607 B2 1/2006 Philipp
6,999,066 B2 2/2006 Litwiller
7,030,513 B2 4/2006 Caldwell
7,046,129 B2 5/2006 Regnet et al.
7,053,360 B2 5/2006 Balp et al.
7,063,379 B2 6/2006 Steuer et al.
7,091,836 B2 8/2006 Kachouh et al.
7,091,886 B2 8/2006 DePue et al.
7,098,414 B2 8/2006 Caldwell
7,105,752 B2 9/2006 Tsai et al.
7,106,171 B1 9/2006 Burgess
7,135,995 B2 11/2006 Engelmann et al.
7,146,024 B2 12/2006 Benkley, III
7,151,450 B2 12/2006 Beggs et al.
7,151,532 B2 12/2006 Schulz
7,154,481 B2 12/2006 Cross et al.
7,180,017 B2 2/2007 Hein
7,186,936 B2 3/2007 Marcus et al.
7,205,777 B2 4/2007 Schulz et al.
7,215,529 B2 5/2007 Rosenau
7,218,498 B2 5/2007 Caldwell
7,232,973 B2 6/2007 Kaps et al.
7,242,393 B2 7/2007 Caldwell
7,245,131 B2 7/2007 Kurachi et al.
7,248,151 B2 7/2007 Mc Call
7,248,955 B2 7/2007 Hein et al.
7,254,775 B2 8/2007 Geaghan et al.
7,255,466 B2 8/2007 Schmidt et al.
7,255,622 B2 8/2007 Stevenson et al.
7,269,484 B2 9/2007 Hein
7,295,168 B2 11/2007 Saegusa et al.
7,295,904 B2 11/2007 Kanevsky et al.
7,339,579 B2 3/2008 Richter et al.
7,342,485 B2 3/2008 Joehl et al.
7,347,297 B2 3/2008 Ide et al.
7,355,595 B2 4/2008 Bathiche et al.
7,361,860 B2 4/2008 Caldwell
7,385,308 B2 6/2008 Yerdon et al.
7,445,350 B2 11/2008 Konet et al.
7,447,575 B2 11/2008 Goldbeck et al.
7,479,788 B2 1/2009 Bolender et al.
7,489,053 B2 2/2009 Gentile et al.
7,518,381 B2 4/2009 Lamborghini et al.
7,521,941 B2 4/2009 Ely et al.
7,521,942 B2 4/2009 Reynolds
7,531,921 B2 5/2009 Cencur
7,532,202 B2 5/2009 Roberts
7,535,131 B1 5/2009 Safieh, Jr.
7,535,459 B2 5/2009 You et al.
7,567,240 B2 7/2009 Peterson, Jr. et al.
7,583,092 B2 9/2009 Reynolds et al.
7,643,010 B2 1/2010 Westerman et al.
7,653,883 B2 1/2010 Hotelling et al.
7,654,147 B2 2/2010 Witte et al.
7,688,080 B2 3/2010 Golovchenko et al.
7,701,440 B2 4/2010 Harley
7,705,257 B2 4/2010 Arione et al.
7,708,120 B2 5/2010 Einbinder
7,710,245 B2 5/2010 Pickering
7,714,846 B1 5/2010 Gray
7,719,142 B2 5/2010 Hein et al.
7,728,819 B2 6/2010 Inokawa
7,737,953 B2 6/2010 Mackey
7,737,956 B2 6/2010 Hsieh et al.
7,777,732 B2 8/2010 Herz et al.
7,782,307 B2 8/2010 Westerman et al.
7,791,594 B2 9/2010 Dunko
7,795,882 B2 9/2010 Kirchner et al.
7,800,590 B2 9/2010 Satoh et al.
7,821,425 B2 10/2010 Philipp
7,834,853 B2 11/2010 Finney et al.
7,839,392 B2 11/2010 Pak et al.
7,876,310 B2 1/2011 Westerman et al.
7,881,940 B2 2/2011 Dusterhoff
RE42,199 E 3/2011 Caldwell
7,898,531 B2 3/2011 Bowden et al.
7,920,131 B2 4/2011 Westerman
7,924,143 B2 4/2011 Griffin et al.
7,957,864 B2 6/2011 Lenneman et al.
7,977,596 B2 7/2011 Born et al.
7,978,181 B2 7/2011 Westerman
7,989,752 B2 8/2011 Yokozawa
8,026,904 B2 9/2011 Westerman
8,050,876 B2 11/2011 Feen et al.
8,054,296 B2 11/2011 Land et al.
8,054,300 B2 11/2011 Bernstein
8,076,949 B1 12/2011 Best et al.
8,077,154 B2 12/2011 Emig et al.
8,090,497 B2 1/2012 Ando
8,253,425 B2 8/2012 Reynolds et al.
8,279,092 B2 10/2012 Vanhelle et al.
8,283,800 B2 10/2012 Salter et al.
8,330,385 B2 12/2012 Salter et al.
8,339,286 B2 12/2012 Cordeiro
8,386,027 B2 2/2013 Chuang et al.
8,400,423 B2 3/2013 Chang et al.
8,415,959 B2 4/2013 Badaye
8,454,181 B2 6/2013 Salter et al.
8,456,180 B2 6/2013 Sitarski
8,508,487 B2 8/2013 Schwesig et al.
8,517,383 B2 8/2013 Wallace et al.
8,537,107 B1 9/2013 Li
8,570,053 B1 10/2013 Ryshtun et al.
8,575,949 B2 11/2013 Salter et al.
8,619,054 B2 12/2013 Philipp et al.
8,624,609 B2 1/2014 Philipp et al.
8,659,414 B1 2/2014 Schuk
8,796,575 B2 8/2014 Salter et al.
8,908,034 B2 12/2014 Bordonaro
8,933,708 B2 1/2015 Buttolo et al.
8,981,265 B2 3/2015 Jiao et al.
2001/0019228 A1 9/2001 Gremm
2001/0028558 A1 10/2001 Rapp et al.
2002/0040266 A1 4/2002 Edgar et al.
2002/0084721 A1 7/2002 Walczak
2002/0093786 A1 7/2002 Maser
2002/0149376 A1 10/2002 Haffner et al.
2002/0167439 A1 11/2002 Bloch et al.
2002/0167704 A1 11/2002 Kleinhans et al.
2003/0002273 A1 1/2003 Anderson, Jr. et al.
2003/0101781 A1 6/2003 Budzynski et al.
2003/0122554 A1 7/2003 Karray et al.
2003/0128116 A1 7/2003 Ieda et al.
2003/0168271 A1* 9/2003 Massen ..... B60K 31/0008 180/167
2003/0189211 A1 10/2003 Dietz
2004/0056753 A1 3/2004 Chiang et al.
2004/0090195 A1 5/2004 Motsenbocker
2004/0145613 A1 7/2004 Stavely et al.
2004/0160072 A1 8/2004 Carter et al.
2004/0160234 A1 8/2004 Denen et al.
2004/0160713 A1 8/2004 Wei
2004/0197547 A1 10/2004 Bristow et al.
2004/0246239 A1 12/2004 Knowles et al.
2005/0012484 A1 1/2005 Gifford et al.

(56) References Cited

U.S. PATENT DOCUMENTS

2005/0052429 A1 3/2005 Philipp
2005/0068045 A1 3/2005 Inaba et al.
2005/0068712 A1 3/2005 Schulz et al.
2005/0073425 A1 4/2005 Snell et al.
2005/0088417 A1 4/2005 Mulligan
2005/0092097 A1 5/2005 Shank et al.
2005/0110769 A1 5/2005 DaCosta et al.
2005/0137765 A1 6/2005 Hein et al.
2005/0183508 A1 8/2005 Sato
2005/0218913 A1 10/2005 Inaba et al.
2005/0242923 A1 11/2005 Pearson et al.
2005/0275567 A1 12/2005 DePue et al.
2005/0283280 A1 12/2005 Evans, Jr.
2006/0022682 A1 2/2006 Nakamura et al.
2006/0038793 A1 2/2006 Philipp
2006/0044800 A1 3/2006 Reime
2006/0055534 A1 3/2006 Fergusson
2006/0082545 A1 4/2006 Choquet et al.
2006/0170241 A1 8/2006 Yamashita
2006/0238518 A1 10/2006 Westerman et al.
2006/0238521 A1 10/2006 Westerman et al.
2006/0244733 A1 11/2006 Geaghan
2006/0250142 A1 11/2006 Abe
2006/0262549 A1 11/2006 Schmidt et al.
2006/0267953 A1 11/2006 Peterson, Jr. et al.
2006/0279015 A1 12/2006 Wang
2006/0287474 A1 12/2006 Crawford et al.
2007/0008726 A1 1/2007 Brown
2007/0023265 A1 2/2007 Ishikawa et al.
2007/0051609 A1 3/2007 Parkinson
2007/0068790 A1 3/2007 Yerdon et al.
2007/0096565 A1 5/2007 Breed et al.
2007/0103431 A1 5/2007 Tabatowski-Bush
2007/0115759 A1 5/2007 Sano
2007/0206668 A1 9/2007 Jin
2007/0226994 A1 10/2007 Wollach et al.
2007/0232779 A1 10/2007 Moody et al.
2007/0247429 A1 10/2007 Westerman
2007/0255468 A1 11/2007 Strebel et al.
2007/0257891 A1 11/2007 Esenther et al.
2007/0271072 A1 11/2007 Kovacevich
2007/0296709 A1 12/2007 GuangHai
2008/0012835 A1 1/2008 Rimon et al.
2008/0018604 A1 1/2008 Paun et al.
2008/0023715 A1 1/2008 Choi
2008/0030465 A1 2/2008 Konet et al.
2008/0074398 A1 3/2008 Wright
2008/0111714 A1 5/2008 Kremin
2008/0136792 A1 6/2008 Peng et al.
2008/0142352 A1 6/2008 Wright
2008/0143681 A1 6/2008 XiaoPing
2008/0150905 A1 6/2008 Grivna et al.
2008/0158146 A1 7/2008 Westerman
2008/0196945 A1 8/2008 Konstas
2008/0202912 A1 8/2008 Boddie et al.
2008/0211519 A1 9/2008 Kurumado et al.
2008/0231290 A1 9/2008 Zhitomirsky
2008/0238650 A1 10/2008 Riihimaki et al.
2008/0246723 A1 10/2008 Baumbach
2008/0257706 A1 10/2008 Haag
2008/0272623 A1 11/2008 Kadzban et al.
2009/0009482 A1 1/2009 McDermid
2009/0046110 A1 2/2009 Sadler et al.
2009/0066659 A1 3/2009 He et al.
2009/0079699 A1 3/2009 Sun
2009/0108985 A1 4/2009 Haag et al.
2009/0115731 A1 5/2009 Rak
2009/0120697 A1 5/2009 Wilner et al.
2009/0135157 A1 5/2009 Harley
2009/0212849 A1 8/2009 Reime
2009/0225043 A1 9/2009 Rosener
2009/0235588 A1 9/2009 Patterson et al.
2009/0236210 A1 9/2009 Clark et al.
2009/0251435 A1 10/2009 Westerman et al.
2009/0256578 A1 10/2009 Wuerstlein et al.
2009/0256677 A1 10/2009 Hein et al.
2009/0273563 A1 11/2009 Pryor
2009/0295409 A1 12/2009 Irkliy
2009/0295556 A1 12/2009 Inoue et al.
2009/0309616 A1 12/2009 Klinghult et al.
2010/0001746 A1 1/2010 Duchene et al.
2010/0001974 A1 1/2010 Su et al.
2010/0007613 A1 1/2010 Costa
2010/0007620 A1 1/2010 Hsieh et al.
2010/0013777 A1 1/2010 Baudisch et al.
2010/0026654 A1 2/2010 Suddreth
2010/0039392 A1 2/2010 Pratt et al.
2010/0053087 A1 3/2010 Dai et al.
2010/0066391 A1 3/2010 Hirasaka et al.
2010/0090712 A1 4/2010 Vandermeijden
2010/0090966 A1 4/2010 Gregorio
2010/0102830 A1 4/2010 Curtis et al.
2010/0103139 A1 4/2010 Soo et al.
2010/0110037 A1 5/2010 Huang et al.
2010/0117970 A1 5/2010 Burstrom et al.
2010/0125393 A1 5/2010 Jarvinen et al.
2010/0156814 A1 6/2010 Weber et al.
2010/0177057 A1 7/2010 Flint et al.
2010/0188356 A1 7/2010 Vu et al.
2010/0188364 A1 7/2010 Lin et al.
2010/0194692 A1 8/2010 Orr et al.
2010/0207907 A1 8/2010 Tanabe et al.
2010/0212819 A1 8/2010 Salter et al.
2010/0214253 A1 8/2010 Wu et al.
2010/0219935 A1 9/2010 Bingle et al.
2010/0241431 A1 9/2010 Weng et al.
2010/0241983 A1 9/2010 Walline et al.
2010/0245286 A1 9/2010 Parker
2010/0250071 A1 9/2010 Pala et al.
2010/0252048 A1 10/2010 Young et al.
2010/0277431 A1 11/2010 Klinghult
2010/0280983 A1 11/2010 Cho et al.
2010/0286867 A1 11/2010 Bergholz et al.
2010/0289754 A1 11/2010 Sleeman et al.
2010/0289759 A1 11/2010 Fisher et al.
2010/0296303 A1 11/2010 Sarioglu et al.
2010/0302200 A1 12/2010 Netherton et al.
2010/0315267 A1 12/2010 Chung et al.
2010/0321214 A1 12/2010 Wang et al.
2010/0321321 A1 12/2010 Shenfield et al.
2010/0321335 A1 12/2010 Lim et al.
2010/0328261 A1 12/2010 Woolley et al.
2010/0328262 A1 12/2010 Huang et al.
2011/0001707 A1 1/2011 Faubert et al.
2011/0001722 A1 1/2011 Newman et al.
2011/0007021 A1 1/2011 Bernstein et al.
2011/0007023 A1 1/2011 Abrahamsson et al.
2011/0012378 A1* 1/2011 Ueno ..... B29C 45/14811 292/336.3
2011/0012623 A1 1/2011 Gastel et al.
2011/0018744 A1 1/2011 Philipp
2011/0018817 A1 1/2011 Kryze et al.
2011/0022393 A1 1/2011 Waller et al.
2011/0031983 A1 2/2011 David et al.
2011/0034219 A1 2/2011 Filson et al.
2011/0037725 A1 2/2011 Pryor
2011/0037735 A1 2/2011 Land et al.
2011/0039602 A1 2/2011 McNamara et al.
2011/0041409 A1 2/2011 Newman et al.
2011/0043481 A1 2/2011 Bruwer
2011/0050251 A1 3/2011 Franke et al.
2011/0050587 A1 3/2011 Natanzon et al.
2011/0050618 A1 3/2011 Murphy et al.
2011/0050620 A1 3/2011 Hristov
2011/0055753 A1 3/2011 Horodezky et al.
2011/0057899 A1 3/2011 Sleeman et al.
2011/0062969 A1 3/2011 Hargreaves et al.
2011/0063425 A1 3/2011 Tieman
2011/0074573 A1 3/2011 Seshadri
2011/0074684 A1 3/2011 Abraham et al.
2011/0080365 A1 4/2011 Westerman
2011/0080366 A1 4/2011 Bolender
2011/0080376 A1 4/2011 Kuo et al.
2011/0082616 A1 4/2011 Small et al.

(56) References Cited

U.S. PATENT DOCUMENTS

| | | | |
|---|---|---|---|
| 2011/0083110 | A1 | 4/2011 | Griffin et al. |
| 2011/0095997 | A1 | 4/2011 | Philipp |
| 2011/0096025 | A1 | 4/2011 | Slobodin et al. |
| 2011/0115732 | A1 | 5/2011 | Coni et al. |
| 2011/0115742 | A1 | 5/2011 | Sobel et al. |
| 2011/0134047 | A1 | 6/2011 | Wigdor et al. |
| 2011/0134054 | A1 | 6/2011 | Woo et al. |
| 2011/0139934 | A1 | 6/2011 | Giesa et al. |
| 2011/0141006 | A1 | 6/2011 | Rabu |
| 2011/0141041 | A1 | 6/2011 | Parkinson et al. |
| 2011/0148803 | A1 | 6/2011 | Xu |
| 2011/0157037 | A1 | 6/2011 | Shamir et al. |
| 2011/0157079 | A1 | 6/2011 | Wu et al. |
| 2011/0157080 | A1 | 6/2011 | Ciesla et al. |
| 2011/0157089 | A1 | 6/2011 | Rainisto |
| 2011/0161001 | A1 | 6/2011 | Fink |
| 2011/0163764 | A1 | 7/2011 | Shank et al. |
| 2011/0169758 | A1 | 7/2011 | Aono |
| 2011/0181387 | A1* | 7/2011 | Popelard ..... B60R 25/246 340/5.2 |
| 2011/0187492 | A1 | 8/2011 | Newman et al. |
| 2011/0210755 | A1 | 9/2011 | Ogawa |
| 2011/0227872 | A1 | 9/2011 | Huska et al. |
| 2011/0279276 | A1 | 11/2011 | Newham |
| 2011/0279409 | A1 | 11/2011 | Salaverry et al. |
| 2011/0309912 | A1 | 12/2011 | Muller |
| 2012/0007821 | A1 | 1/2012 | Zaliva |
| 2012/0037485 | A1 | 2/2012 | Sitarski |
| 2012/0043973 | A1 | 2/2012 | Kremin |
| 2012/0043976 | A1 | 2/2012 | Bokma et al. |
| 2012/0055557 | A1 | 3/2012 | Belz et al. |
| 2012/0062247 | A1 | 3/2012 | Chang |
| 2012/0062498 | A1 | 3/2012 | Weaver et al. |
| 2012/0068956 | A1 | 3/2012 | Jira et al. |
| 2012/0104790 | A1 | 5/2012 | Plavetich et al. |
| 2012/0154324 | A1 | 6/2012 | Wright et al. |
| 2012/0217147 | A1 | 8/2012 | Porter et al. |
| 2012/0293447 | A1 | 11/2012 | Heng et al. |
| 2012/0312676 | A1 | 12/2012 | Salter et al. |
| 2012/0313648 | A1 | 12/2012 | Salter et al. |
| 2012/0313767 | A1 | 12/2012 | Sitarski |
| 2012/0319992 | A1 | 12/2012 | Lee |
| 2013/0002419 | A1* | 1/2013 | Lee ..... B60Q 9/008 340/457 |
| 2013/0024169 | A1 | 1/2013 | Veerasamy |
| 2013/0033356 | A1 | 2/2013 | Sitarski et al. |
| 2013/0036529 | A1 | 2/2013 | Salter et al. |
| 2013/0076121 | A1 | 3/2013 | Salter et al. |
| 2013/0076375 | A1 | 3/2013 | Hanumanthaiah et al. |
| 2013/0093500 | A1 | 4/2013 | Bruwer |
| 2013/0106436 | A1 | 5/2013 | Brunet et al. |
| 2013/0113397 | A1 | 5/2013 | Salter et al. |
| 2013/0113544 | A1 | 5/2013 | Salter et al. |
| 2013/0126325 | A1 | 5/2013 | Curtis et al. |
| 2013/0170013 | A1 | 7/2013 | Tonar et al. |
| 2013/0270896 | A1 | 10/2013 | Buttolo et al. |
| 2013/0270899 | A1 | 10/2013 | Buttolo et al. |
| 2013/0271157 | A1 | 10/2013 | Buttolo et al. |
| 2013/0271159 | A1 | 10/2013 | Santos et al. |
| 2013/0271182 | A1 | 10/2013 | Buttolo et al. |
| 2013/0271202 | A1 | 10/2013 | Buttolo et al. |
| 2013/0271203 | A1 | 10/2013 | Salter et al. |
| 2013/0271204 | A1 | 10/2013 | Salter et al. |
| 2013/0291439 | A1 | 11/2013 | Wuerstlein et al. |
| 2013/0307610 | A1 | 11/2013 | Salter et al. |
| 2013/0321065 | A1 | 12/2013 | Salter et al. |
| 2013/0328616 | A1 | 12/2013 | Buttolo et al. |
| 2014/0002405 | A1 | 1/2014 | Salter et al. |
| 2014/0069015 | A1 | 3/2014 | Salter et al. |
| 2014/0116869 | A1 | 5/2014 | Salter et al. |
| 2014/0145733 | A1 | 5/2014 | Buttolo et al. |
| 2014/0210257 | A1 | 7/2014 | Buttolo et al. |
| 2014/0252879 | A1 | 9/2014 | Dassanayake et al. |
| 2014/0278194 | A1 | 9/2014 | Buttolo et al. |
| 2014/0278240 | A1 | 9/2014 | Buttolo et al. |
| 2014/0306723 | A1 | 10/2014 | Salter et al. |
| 2014/0306724 | A1 | 10/2014 | Dassanayake et al. |
| 2015/0180471 | A1 | 6/2015 | Buttolo et al. |
| 2015/0229305 | A1 | 8/2015 | Buttolo et al. |
| 2015/0234493 | A1 | 8/2015 | Parivar et al. |

FOREIGN PATENT DOCUMENTS

| | | |
|---|---|---|
| EP | 1327860 | 7/2003 |
| EP | 1562293 | 8/2005 |
| EP | 2133777 | 10/2011 |
| GB | 2071338 | 9/1981 |
| GB | 2158737 | 11/1985 |
| GB | 2279750 | 1/1995 |
| GB | 2409578 | 6/2005 |
| GB | 2418741 | 4/2006 |
| JP | 61188515 | 8/1986 |
| JP | 4065038 | 3/1992 |
| JP | 04082416 | 3/1992 |
| JP | 07315880 | 12/1995 |
| JP | 08138446 | 5/1996 |
| JP | 11065764 | 3/1999 |
| JP | 11110131 | 4/1999 |
| JP | 11260133 | 9/1999 |
| JP | 11316553 | 11/1999 |
| JP | 2000047178 | 2/2000 |
| JP | 2000075293 | 3/2000 |
| JP | 2001013868 | 1/2001 |
| JP | 2006007764 | 1/2006 |
| JP | 2007027034 | 2/2007 |
| JP | 2008033701 | 2/2008 |
| JP | 2010139362 | 6/2010 |
| JP | 2010165618 | 7/2010 |
| JP | 2010218422 | 9/2010 |
| JP | 2010239587 | 10/2010 |
| JP | 2010287148 | 12/2010 |
| JP | 2011014280 | 1/2011 |
| KR | 20040110463 | 12/2004 |
| KR | 20090127544 | 12/2009 |
| KR | 20100114768 | 10/2010 |
| KR | 101258376 | 4/2013 |
| WO | 9636960 | 11/1996 |
| WO | 9963394 | 12/1999 |
| WO | 2006093398 | 9/2006 |
| WO | 2007022027 | 2/2007 |
| WO | 2008121760 | 10/2008 |
| WO | 2009054592 | 4/2009 |
| WO | 2010111362 | 9/2010 |
| WO | 2012032318 | 3/2012 |
| WO | 2012169106 | 12/2012 |

OTHER PUBLICATIONS

"Introduction to Touch Solutions, White Paper, Revision 1.0 A," Densitron Corporation, 14 pages, Aug. 21, 2007.

Kliffken, Marksu G. et al., "Obstacle Detection for Power Operated Window-Lift and Sunroof Actuation Systems," Paper No. 2001-01-0466, 1 page, © 2011 SAE International, Published Mar. 5, 2001.

NXP Capacitive Sensors, 1 page, www.nxp.com, copyrighted 2006-2010, NXP Semiconductors.

"Moisture Immunity in QuickSense Studio," AN552, Rev. 0.1 10/10, 8 pages, Silicon Laboratories, Inc., © 2010.

"Orgacon EL-P3000, Screen printing Ink Series 3000," 2 pages, AGFA, last updated in Feb. 2006.

"Charge-Transfer Sensing-Based Touch Controls Facilitate Creative Interfaces," www.ferret.com.au, 2 pages, Jan. 18, 2006.

Kiosk Peripherals, "Touch Screen," www.bitsbytesintegrators.com/kiosk-peripherals.html, 10 pages, no date provided.

JVC KD-AVX777 Detachable Front-Panel with Integrated 5.4" Touch-Screen Monitor, 6 pages, www.crutchfield.com, no date provided.

Ergonomic Palm Buttons, Pepperl+Fuchs, www.wolfautomation.com, 6 pages, no date provided.

"Touch Sensors Design Guide" by ATMEL, 10620 D-AT42-04/09, Revised Apr. 2009, 72 pages, Copyrighted 2008-2009 Atmel Corporation.

(56) References Cited

OTHER PUBLICATIONS

"Capacitive Touch Switches for Automotive Applications," by Dave Van Ess of Cypress Semiconductor Corp., published in Automotive DesignLine (http://www.automotivedesignline.com), Feb. 2006, 7 pages.
U.S. Appl. No. 14/518,141, filed Oct. 20, 2014, entitled "Directional Proximity Switch Assembly," (23 pages of specification, 13 pages of drawings) and Official Filing Receipt (3 pages).
U.S. Appl. No. 14/689,324, filed Apr. 17, 2015, entitled "Proximity Switch Assembly With Signal Drift Rejection and Method," (35 pages of specification and 17 pages of drawings) and Official Filing Receipt (3 pages).
U.S. Appl. No. 14/635,140, filed Mar. 2, 2015, entitled "Proximity Switch Having Wrong Touch Adaptive Learning and Method," (20 pages of specification and 7 pages of drawings) and Official Filing Receipt (3 pages).
U.S. Appl. No. 14/661,325, filed Mar. 18, 2015, entitled "Proximity Switch Assembly Having Haptic Feedback and Method," (31 pages of specification and 15 pages of drawings) and Official Filing Receipt (3 pages).
U.S. Appl. No. 14/717,031, filed May 20, 2015, entitled "Proximity Sensor Assembly Having Interleaved Electrode Configuration," (38 pages of specification and 21 pages of drawings) and Official Filing Receipt (3 pages).

* cited by examiner

PROXIMITY SWITCH BASED DOOR LATCH RELEASE

CROSS-REFERENCE TO RELATED APPLICATION

This application is a continuation of U.S. patent application Ser. No. 13/609,390, filed on Sep. 11, 2012, now U.S. Pat. No. 8,922,340, entitled "PROXIMITY SWITCH BASED DOOR LATCH RELEASE." The aforementioned related application is hereby incorporated by reference.

FIELD OF THE INVENTION

The present invention generally relates to door latch release assemblies, and more particularly relates to a proximity sensor based latch assembly that releases a vehicle door latch to allow the door to open.

BACKGROUND OF THE INVENTION

Automotive vehicles include various door assemblies for allowing access to the vehicle, such as passenger doors allowing access to the passenger compartment. The vehicle doors typically include a mechanical latch assembly that latches the door in the closed position and is operable by a user to unlatch the door to allow the door to open. For example, a passenger may actuate a pivoting release mechanism by pulling on the mechanism to unlatch the vehicle door. The latch may be locked further with a door lock mechanism that typically is actuated with another input by the user.

SUMMARY OF THE INVENTION

According to one aspect of the present invention, a method of actuating a vehicle latch assembly is provided. The method includes the steps of detecting a user's hand gripping a handle for a door in a vehicle with proximity sensors on first and second sides of the handle, and actuating a door latch to unlatch the door based on the hand gripping the handle. The method further includes the steps of detecting with the proximity sensors an object in close proximity to the handle, and activating a warning when the object is detected.

According to another aspect of the present invention, a method of controlling a vehicle door latch assembly. The method includes the steps of detecting a hand gripping a door handle in a vehicle with first and second proximity sensors on first and second sides, determining when the vehicle is moving, and performing an action other than activating a door latch to an unlatched position immediately following the detection of a valid hand grip when the vehicle is moving.

According to a further aspect of the present invention, a door latch assembly is provided. The door latch assembly includes first capacitive sensors on a first side of a door handle, a second capacitive sensor on a second side of the door handle, and a latch operative to latch the door closed and to unlatch the door to allow the door to open. The door latch assembly also includes control circuitry for activating the latch to unlatch the door based on an object sensed with the first capacitive sensors and the second capacitive sensor.

These and other aspects, objects, and features of the present invention will be understood and appreciated by those skilled in the art upon studying the following specification, claims, and appended drawings.

DETAILED DESCRIPTION OF THE PREFERRED EMBODIMENTS

As required, detailed embodiments of the present invention are disclosed herein; however, it is to be understood that the disclosed embodiments are merely exemplary of the invention that may be embodied in various and alternative forms. The figures are not necessarily to a detailed design; some schematics may be exaggerated or minimized to show function overview. Therefore, specific structural and functional details disclosed herein are not to be interpreted as limiting, but merely as a representative basis for teaching one skilled in the art to variously employ the present invention.

Figure 1:
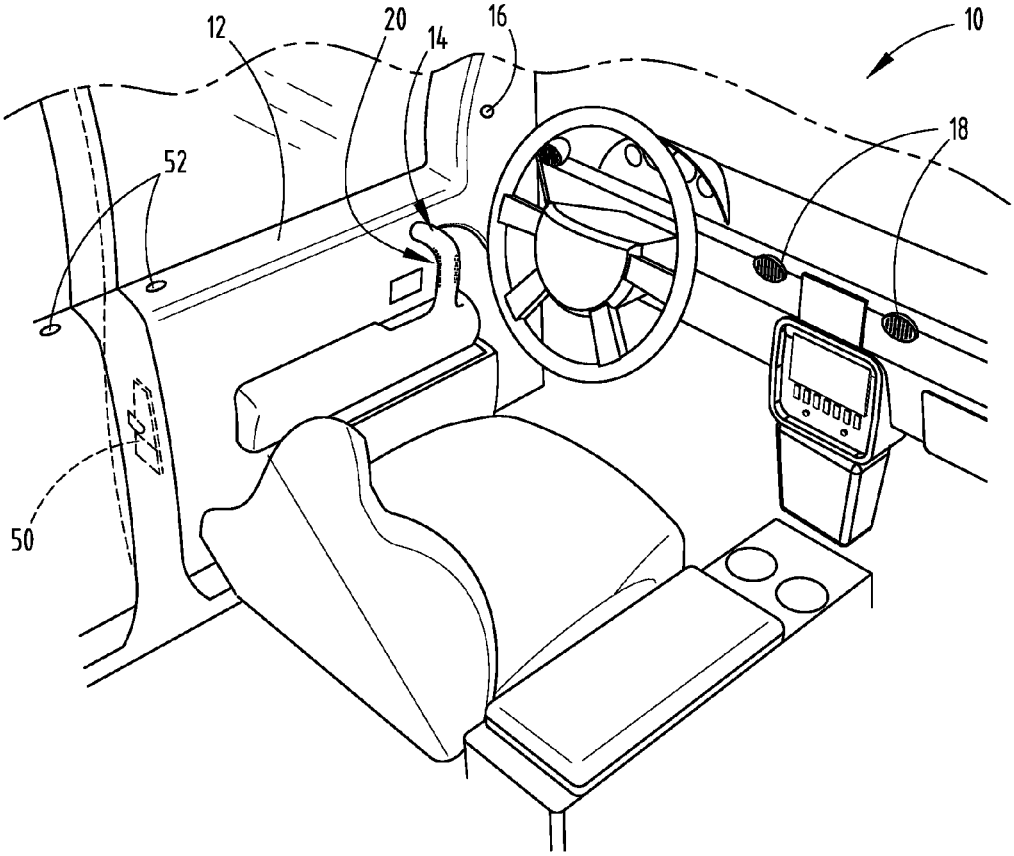
FIG. 1 is a perspective view of a passenger compartment of an automotive vehicle having a vehicle door employing a proximity sensor activated door latch assembly, according to one embodiment.
Figure 2:
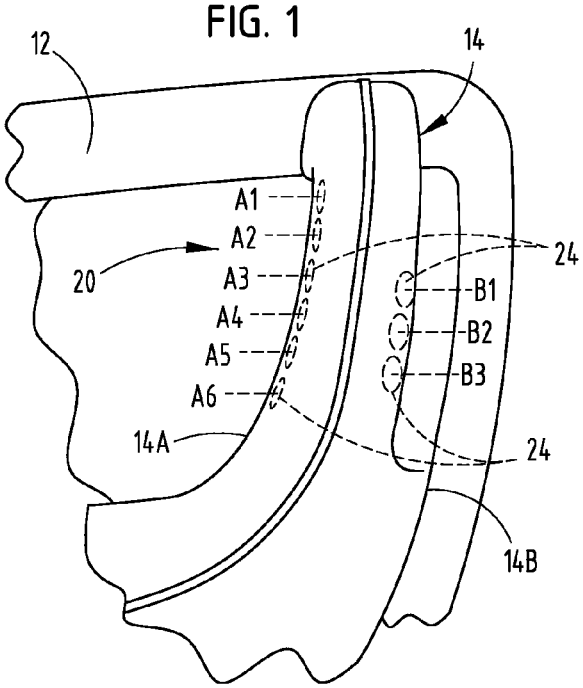
FIG. 2 is an enlarged side view of the door handle showing the door latch assembly on the grip portion of the door handle.

Referring to FIGS. 1 and 2, an interior of an automotive vehicle 10 is generally illustrated having a passenger compartment and a vehicle door 12 that may be in the closed position as shown in FIG. 1 or may pivot about hinge assemblies (not shown) to an open position to allow access to the passenger compartment. The door 12 has a handle 14 with a grip portion that allows an operator's hand to grip the handle 14 to forcibly swing the door 12 between open and closed positions. The door 12 also includes a latch assembly 20 for latching the door 12 in the closed position to maintain the door closed and for unlatching the door to allow the door to open to an open position. The latch assembly 20 includes an actuatable latch such as an electromagnetic actuated latch 50 that changes the position of the latch between latched and unlatched positions in response to a control signal. While the vehicle 10 is shown having a front driver side door 12, it should be appreciated that the vehicle may be equipped with a plurality of doors each employing the latch assembly 20 as described herein.

The latch assembly 20 employs a plurality of proximity sensors 24 on the grip portion of the handle 14 to allow an operator to actuate the latch 50 to the unlatched position to release the door and allow the door to open. Included are at least first and second proximity sensors on first and second sides of the door handle for sensing an object, such as an operator's hand gripping the handle. Control circuitry activates the latch via a control signal to unlatch the door 12 based on an object sensed with both the first and second proximity sensors 24. As such, the first and second proximity sensors 24 operate together as a proximity switch to switch the latch 50 to the unlatched position when both the first and second proximity sensors detect an adult hand gripping the handle. Additionally, the proximity sensors 24 may be employed to allow an operator to lock and unlock the latch assembly 20 as described herein.

The vehicle 10 further includes one or more warning lights 16, such as light 16 forward of the driver seat shown in the A-pillar in FIG. 1. Warning light 16 may serve as a visual indication of a sensed condition of the proximity sensors such as to indicate an inadvertent contact of an object on one of the first and second sensors. Additionally, one or more audio speakers 18 are provided in the vehicle to provide a chime output warning to provide a sound indication to alert the passenger(s) of an inadvertent contact of an object on one of the sensors as described herein and to alert the driver or occupant of an anticipated activation of the latch when the vehicle is not in park or is in motion.

Figure 3:
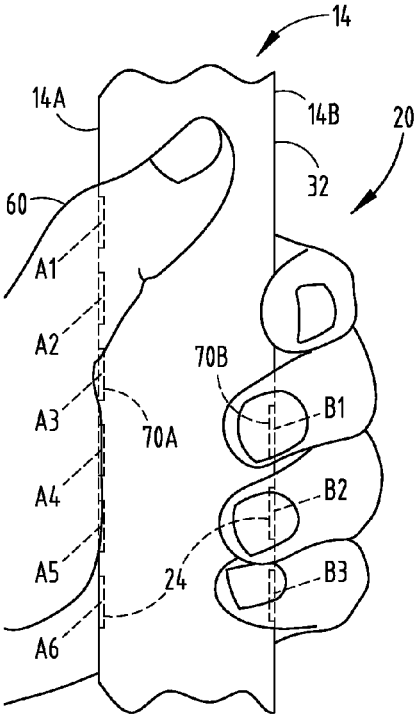
FIG. 3 is an enlarged partial view of the handle grip portion further illustrating an operator hand gripping the grip portion to unlatch the door.
Figure 4:
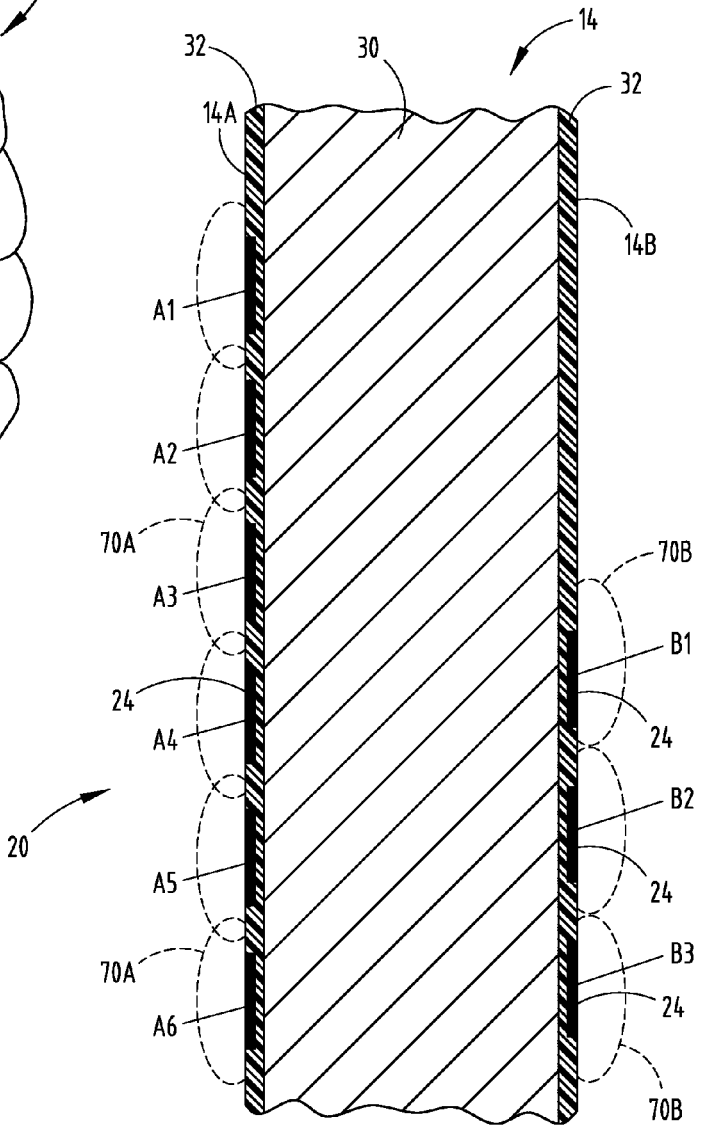
FIG. 4 is an enlarged cross-sectional view taken through the door handle further illustrating the array of proximity sensors and corresponding activation fields.

Referring to FIGS. 2-4, the handle 14 employing the latch assembly 20 is further illustrated having a plurality of proximity sensors 24, also labeled and referred to as first proximity sensors A1-A6 and second proximity sensors B1-B3 arranged on first and second sides 14A and 14B of the grip portion of the handle 14. In one embodiment, a first linear array of proximity sensors A1-A6 are arranged on a first side of the handle 14 and a second linear array of proximity sensors B1-B3 are arranged on a second opposite side of the handle 14. The first array of proximity sensors A1-A6 extends vertically on one side 14A and the second array of proximity sensors B1-B3 extends vertically on the opposite side 14B. The first and second arrays of proximity sensors A1-A6 and B1-B3 are of a size and positioned so as to be engaged by an operator's hand 60 as seen in FIG. 3. As an operator's hand 60 engages and grips the handle 14, the thumb and palm of the hand 60 come into contact or close proximity to one or more of the first array of proximity sensors A1-A6 and the fingers wrap around the handle 14 such that the fingers at an end closer to the proximal tip thereof come into contact or close proximity to the second array of proximity sensors B1-B3. The proximity sensors A1-A6 and B1-B3 thereby detect the simultaneous presence of an operator's hand on both first and second sides 14A and 14B of the handle 14 which is indicative of an operator gripping the handle 14 so as to initiate a latch open activation command to unlatch the latch and thereby releases the door such that the door may open.

In the embodiment shown, the first array of proximity sensors A1-A6 include six sensors and the second array of proximity sensors B1-B3 includes three sensors; however, it should be appreciated that one or more sensors may be employed in each of the first and second arrays of proximity sensors. Additionally, it should be appreciated that the first array of first proximity sensors A1-A6 and the second array of second proximity sensors B1-B3 are on opposite sides 14A and 14B of the handle 14, according to one embodiment. However, the first and second array of proximity sensors may be provided on different sides of the handle where the first side is at an angle greater than ninety degrees (90°) relative to the second side according to other embodiments. It should further be appreciated that the handle 14 and the proximity sensors 24 may be oriented in other directions other than the generally vertical orientation shown herein. It should be appreciated that by applying a second array of proximity sensors B1-B3 on the back side of the door handle in addition to the first array of proximity sensors A1-A6 on the front side of the door handle is achieved with minimal extra costs since both arrays of proximity sensors may be electrically coupled to shared control circuitry and processed together therewith.

The proximity sensors 24 are shown and described herein as capacitive sensors, according to one embodiment. Each proximity sensor 24 includes at least one proximity sensor that provides a sense activation field to sense contact or close proximity (e.g., within one millimeter) of an object, such as the hand (e.g., palm or finger(s)) of an operator in relation to the one or more proximity sensors. Thus, the first and second arrays of capacitive sensors operate as a capacitive switch. The proximity sensors 24 may also detect a swiping motion by the hand of the operator such as a swipe of the thumb or other finger. Thus, the sense activation field of each proximity sensor 24 is a capacitive field in the exemplary embodiment and the user's hand including the palm, thumb and other fingers have electrical conductivity and dielectric properties that cause a change or disturbance in the sense activation field as should be evident to those skilled in the art. However, it should also be appreciated by those skilled in the art that additional or alternative types of proximity sensors can be used, such as, but not limited to, inductive sensors, optical sensors, temperatures sensors, resistive sensors, the like, or a combination thereof. Exemplary proximity sensors are described in the Apr. 9, 2009, ATMEL® Touch Sensors Design Guide, 10620 D-AT42-04/09, the entire reference hereby being incorporated herein by reference.

Referring to FIG. 4, the door handle 14 is shown having the capacitive sensors A1-A6 and B1-B3 formed on the outer surface of an inner substrate 30 of handle 14. Alternatively, the sensors could be formed on the inner surface of an outer covering layer 32 overlaying the inner substrate 30. According to one embodiment, each of the proximity sensors 24 may be formed by printing conductive ink onto the outer surface of the inner substrate 30 which provides the support for the handle 14 such that a user is able to grip the handle 14 and push the handle 14 to open the door 12 or pull the handle 14 to close the door 12. The door handle 14 should be sufficiently rigid and strong to allow an operator to easily swing the door 14 between open and closed positions.

Figure 5:
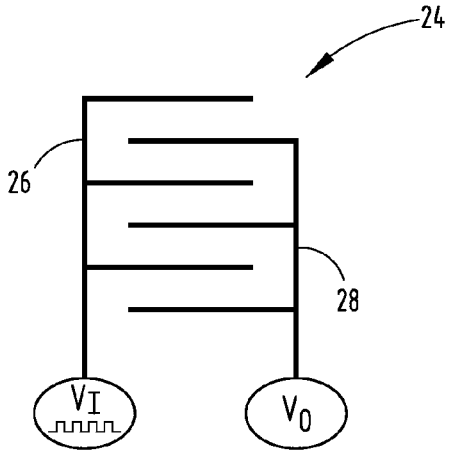
FIG. 5 is a schematic diagram of a capacitive sensor employed in each of the proximity capacitive sensors shown in FIGS. 1-4.

One example of the printed ink proximity sensor 24 is shown in FIG. 5 having a drive electrode 26 and a receive electrode 28 each having interdigitated fingers for generating a capacitive field. It should be appreciated that each of the proximity sensors 24 may be otherwise formed such as by assembling a preformed conductive circuit trace onto a substrate according to other embodiments. The drive electrode 26 receives square wave drive pulses applied at voltage $V_I$. The receive electrode 28 has an output for generating an output voltage $V_O$. It should be appreciated that the electrodes 26 and 28 may be arranged in various other configurations for generating the capacitive field as the activation field.

In the embodiment shown and described herein, the drive electrode 26 of each proximity sensor 24 is applied with voltage input $V_I$ as square wave pulses having a charge pulse cycle sufficient to charge the receive electrode 28 to a desired voltage. The receive electrode 28 thereby serves as a measurement electrode. In the embodiment shown, adjacent sense activation fields 70A or 70B generated by adjacent proximity sensors 24 overlap, however, more or less overlap may exist according to other embodiments. When a user or operator, such as the user's hand or thumb or other finger(s), enters an activation field, the latch assembly 20 detects the disturbance caused by the hand or fingers to the activation field and determines whether the disturbance in both activation fields 70A and 70B is sufficient to activate a door unlatch command. The disturbance of each activation field is detected by processing the charge pulse signal associated with the corresponding signal channel. When the user's hand or fingers enters the activation fields 70A or 70B generated by the first and second arrays of sensors A1-A6 and B1-B3, the latch assembly 20 detects the disturbance of each contacted activation field via separate signal channels. Each proximity sensor 24 may have its own dedicated signal channel generating charge pulse counts which may be processed.

Each of the first and second capacitive sensors A1-A6 and B1-B3 is shown generating a sense activation field 70A or 70B. The sense activation fields 70A and 70B generated by each individual sensor in each array are shown slightly overlapping, however, it should be appreciated that the activation fields may be smaller or larger and may overlap more or less depending on the sensitivity of the individual fields. By employing a plurality of activation fields on one or both sides of the handle 14, the size and shape of the hand gripping the handle 14 may be determined based on the size of the object being greater than a predetermined size. The size and shape of the hand can be determined based on the number of sensors contacted and/or amplitude of the activation fields. This enables the latch assembly 20 to determine whether an adult or a child is gripping the handle 14 such that activation of the latch may be prevented when a small handle indicative of a child is determined to be gripping the handle and allowed only when a large hand indicative of an adult is determined to be gripping the handle.

In addition, a gesture or swipe motion of the hand, such as a swipe or gesture motion of one or more of the thumb or other fingers may be determined by employing the plurality of capacitive sensors in one or more of the linear arrays. The operator may move one of the digits, such as the thumb, downward which may be sensed with sequential detection by the plurality of capacitive sensors A1-A6 as the thumb passes through each of the sensor activation fields 70A-70F sequentially to initiate a door lock command to lock the latch in the closed or latched position which prevents the door from opening. Contrarily, a digit, such as the thumb, may be moved upward and detected sequentially by the capacitive sensors 70A-70F indicative of a command to unlock the latch to allow the latch assembly to move to the unlatched position to thereby allow the door to be opened. Similarly, other digits or movement of the hand in general may be employed to move up or down and be detected as a swipe or gesture to initiate lock and unlock commands for the latch assembly 20.

Figure 6:
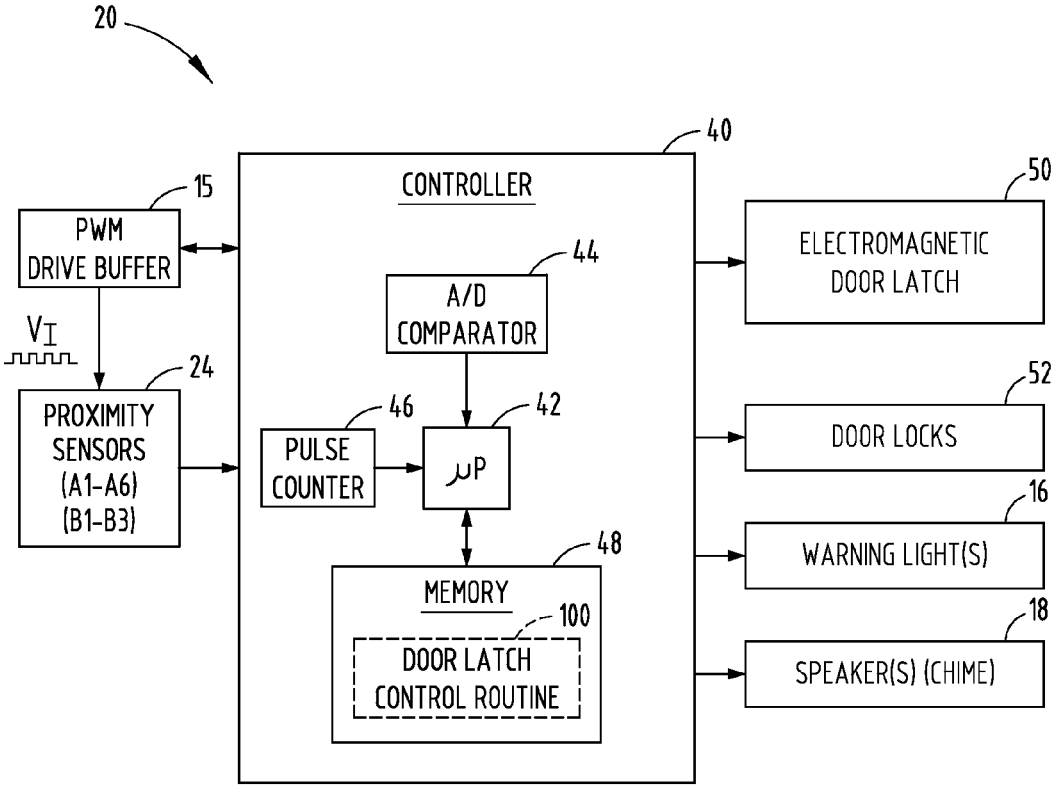
FIG. 6 is a block diagram illustrating the door latch assembly, according to one embodiment.
Figure 7:
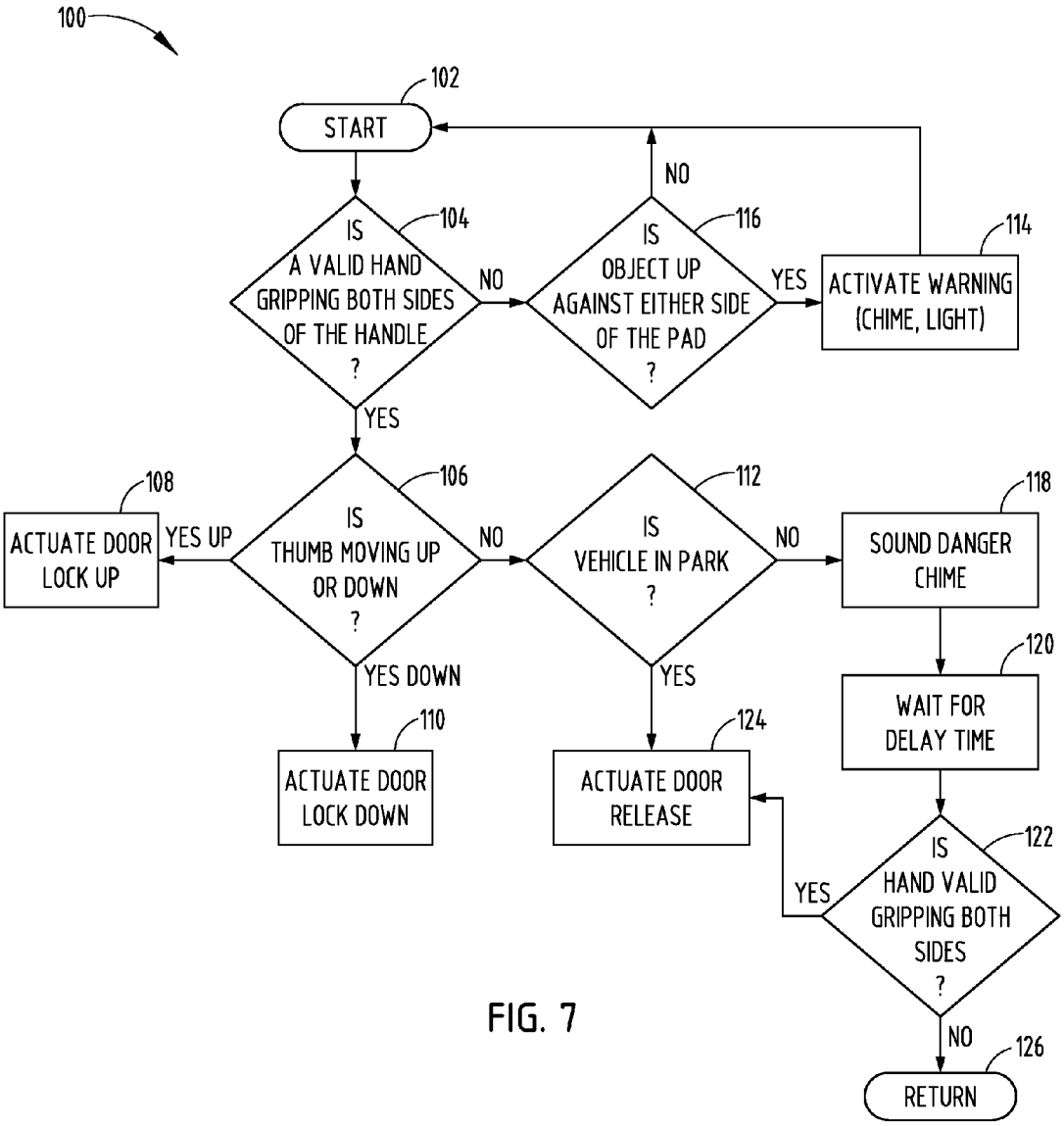
FIG. 7 is a flow diagram illustrating a routine for activating the vehicle door latch assembly, according to one embodiment.

Referring to FIG. 6, the proximity sensor activated latch assembly 20 is illustrated according to one embodiment. The plurality of proximity sensors 24 in sensor arrays A1-A6 and B1-B3 are shown providing inputs to a controller 40, such as a microcontroller. The controller 40 may include control circuitry, such as a microprocessor 42 and memory 48. The control circuitry may include sense control circuitry processing the activation field signal associated with each proximity sensor 24 to sense user activation of each sensor by comparing the activation field signal to one or more thresholds pursuant to one or more control routines. It should be appreciated that other analog and/or digital control circuitry may be employed to process each activation field signal, determine user activation, and initiate an action. The controller 40 may employ a QMatrix acquisition method available by ATMEL®, according to one embodiment. The ATMEL acquisition method employs a WINDOWS® host C/C++ compiler and debugger WinAVR to simplify development and testing the utility Hawkeye that allows monitoring in real-time the internal state of critical variables in the software as well as collecting logs of data for post-processing.

The controller 40 provides an output signal to one or more devices that are configured to perform dedicated actions responsive to detected activation of the proximity sensors on the door handle. The one or more devices may include an electromagnetic door latch 50 that is actuatable to move the latch to a first position or latch position to keep the door closed or to a second or unlatch position to allow the door to open. The electromagnetic door latch 50 may include a conventional electromagnetic actuated latch that moves the latch 50 between the first and second positions based on a control signal from the controller 40. It should be appreciated that other actuatable latches may be employed to move the latch 50 between the first and second positions, such as a pneumatic latch assembly, a motor, or other electrically activated mechanism.

The controller 40 also outputs a control signal to the door lock 52 to activate the door lock between locked and unlocked positions. The electromagnetic latch 50 may be operatively coupled to the door lock 52. When the door lock 52 is in the locked state, the electromagnetic door latch 50 is prevented from moving to the unlatch position. The electromagnetic door latch 50 may only unlatch to the unlatched position when the door lock 52 is in the unlocked position.

The controller 40 further provides output signals to one or more warning lights 16. The warning lights may include one or more LEDs or other light sources at a location visible to the occupant, such as a driver of the vehicle. The warning light(s) may be located in the A-pillar as shown in FIG. 1, or at other suitable locations. Additionally, controller 40 provides an output signal to one or more audio speakers to provide an audible chime sound indicative of a warning. The one or more of the warning lights 16 and speakers 18 may serve as warning indicators to the passengers in the vehicle when an object is detected in close proximity to the proximity sensors such as an inadvertent contact with one sensor or sensor array. The one or more warning lights 16 and speakers 18 may also serve as warning indicators when a potential door unlatch command is detected while the vehicle is not in park and may be moving. The warning may be followed by a time delay such as three seconds prior to unlatching the latch, thereby giving the operator time to consider the intended command.

The controller 40 is further shown having an analog to digital (A/D) comparator 44 coupled to the microprocessor 42. The A/D comparator 44 receives the voltage output $V_O$ from each of the proximity sensors 24, converts the analog signal to a digital signal, and provides the digital signal to the microprocessor 42. Additionally, controller 40 includes a pulse counter 46 coupled to the microprocessor 42. The pulse counter 46 counts the charge signal pulses that are applied to each drive electrode of each proximity sensor, performs a count of the pulses needed to charge the capacitor until the voltage output $V_O$ reaches a predetermined voltage, and provides the count to the microprocessor 42. The pulse count is indicative of the change in capacitance of the corresponding capacitive sensor. The controller 40 is further shown communicating with a pulse width modulated drive buffer 15. The controller 40 provides a pulse width modulated signal to the pulse width modulated drive buffer 15 to generate a square wave pulse train $V_I$ which is applied to each drive electrode of each proximity sensor 24. The controller 40 processes one or more control routines, shown in one embodiment including door latch control routine 100 stored in memory to monitor and make a determination as to activation of one of the proximity switches.

The door latch control routine 100 processes the various proximity sensors 24 and performs a method of sensing user input commanded on each of the proximity sensors and activating control of the latch assembly. Method 100 begins at step 102 and proceeds to decision step 104 to determine if a valid hand gripping is detected on both sides of the handle with the first and second proximity sensors. A valid hand grip may be detected when an object of a sufficient size greater than a predetermined size is detected on both sides of the grip portion of the handle. If a valid hand gripping is detected on the handle by the sensors, method 100 proceeds to decision step 106 to determine if the thumb or other digit on the hand is moving up or down. If the thumb or other digit of the hand is determined to be moving up, method 100 proceeds to step 108 to actuate the door lock up which is indicative of a door unlock command that unlocks the door lock to allow the latch assembly to activate the latch to the door open position. If the thumb or other digit is determined to be moving down, then method 100 proceeds to step 110 to actuate the door lock down which is indicative of a door lock command to prevent the latch from opening. If neither the thumb nor other digit is moving up or down, method 100 proceeds to step 112 to determine if the vehicle is in the park state which is indicative that the vehicle may not be moving. The park state may be determined by the vehicle transmission or by vehicle speed. If the vehicle is in park, method 100 proceeds to step 124 to actuate the door latch to release to thereby allow the door to open. If the vehicle is not in park, method 100 activates a sound danger chime at step 118 to notify the occupants that the vehicle may still be moving at the time that a potential door latch release command is detected. Method 100 then waits for a delay time, such as three seconds before allowing the door latch to be released at step 124. The time delay thereby provides the operator sufficient time to disengage gripping of the handle if door actuation of the latch assembly is no longer the intended command. As such, method 100 will first determine if a valid hand gripping is detected on both sides at step 122 before actuating the door latch release to the unlatched position.

If a valid hand gripping on both sides of the handle is not detected at step 104, method 100 proceeds to decision step 116 to determine if an object is up against either side of the pad and, if so, activates a warning chime and/or light at step 114. Accordingly, if an object inadvertently is in close proximity to one or more of the capacitive sensors, a warning light or sound indicator is provided to the operator such that the operator may move the object from the capacitive sensors and not inadvertently release the latch and open the door.

Accordingly, the door latch assembly method advantageously allow for activation of the latch to unlatch the door based on an object sensed with first and second proximity sensors on first and second sides of the door handle. The system and method advantageously allows a user to effectively open the vehicle door without having to actuate a mechanical input lever, and thereby providing for a robust door release latch having fewer moving parts and which is cost-effective and easy to operate.

It is to be understood that variations and modifications can be made on the aforementioned structure without departing from the concepts of the present invention, and further it is to be understood that such concepts are intended to be covered by the following claims unless these claims by their language expressly state otherwise.

What is claimed is:

1. A method of actuating a vehicle latch assembly comprising: detecting a user's hand gripping an interior handle for a door m a vehicle with proximity sensors on first and second sides of the handle;

actuating a door latch to unlatch the door based on the hand gripping the handle;

detecting with the proximity sensors an object inside the vehicle not gripping the handle and in close proximity to the handle; and activating a warning when the object is detected.

2. The method of claim 1, wherein the first side is substantially opposite the second side.

3. The method of claim 1, wherein the latch comprises an electromagnetic latch.

4. The method of claim 1 further comprising the step of detecting when the vehicle is in park, wherein another warning is activated when the vehicle is not in park.

5. The method of claim 4 further comprising the step of waiting for a time delay if the vehicle is moving, and actuating the door latch to unlatch the door following the time delay when a hand is detected gripping the door handle.

6. The method of claim 1 further comprising the step of detecting movement of the hand in a direction on one of the proximity sensors and determining a swipe motion indicative of one of a door lock and unlock command to cause the door latch to lock or unlock based on the command.

7. The method of claim 1 further comprising the step of determining a size of the hand relative to one of the proximity sensors based on a plurality of sensor fields and providing an output signal only when the size exceeds a predetermined size.

8. The method of claim 1, wherein the proximity sensors comprise capacitive sensors.

9. A method of controlling a vehicle door latch assembly comprising:

detecting a hand gripping a door handle in a vehicle with first and second proximity sensors on first and second sides of the door handle;

determining when the vehicle is moving;

waiting for a time delay when the vehicle is moving; and actuating the door release to the unlocked position following expiration of the time delay.

10. The method of claim 9, wherein the action comprises performing an action other than activating a door latch to an unlatched position immediately following the detection of a valid hand grip when the vehicle is moving.

11. The method of claim 10, wherein the action comprises sounding an alarm.

12. The method of claim 9, wherein the first side is substantially opposite the second side.

13. The method of claim 9 further comprising the step of detecting movement of the hand in a direction on one of the proximity sensors and determining a swipe motion indicative of one of a door lock and unlock command, to cause the door latch to lock or unlock based on the command.

14. The method of claim 9 further comprising the step of determining a size of the hand relative to one of the proximity sensors based on a plurality of sensor fields and providing an output signal only when the size exceeds a predetermined size.

15. The method of claim 9, wherein the proximity sensors comprise capacitive sensors.

16. A door latch assembly comprising:

first capacitive, sensors on a first side of an interior door handle;

a second capacitive sensor on a second side of the door handle;

a latch operative to latch the door closed and to unlatch the door to allow the door to open; and control circuitry for activating the latch to unlatch the door based on a hand sensed with the first capacitive sensors and the second capacitive sensor, wherein the control circuitry further detects with the first and second capacitive sensors an object inside the vehicle that is not gripping the handle and is in close proximity to the handle, and further activates a warring, when the object is detected.

17. The door latch assembly of claim 16, wherein the second capacitive sensor comprises a plurality of second capacitive sensors.

18. The door latch assembly of claim 16, wherein the assembly determines at least one of a swipe and a hand size based on signals generated by the first capacitive sensors.

19. The door latch assembly of claim 16, wherein the control circuitry determines the hand gripping the handle and further determines if the vehicle is moving and performs an action other than activating the door latch to an unlatched position immediately following the detection of a hand gripping the handle when the vehicle is determined to be moving.

* * * * *